US011420793B2

(12) United States Patent
Fischer

(10) Patent No.: US 11,420,793 B2
(45) Date of Patent: Aug. 23, 2022

(54) PAINT BUCKET INSERT

(71) Applicant: Jeffrey Fischer, Broken Arrow, OK (US)

(72) Inventor: Jeffrey Fischer, Broken Arrow, OK (US)

( * ) Notice: Subject to any disclaimer, the term of this patent is extended or adjusted under 35 U.S.C. 154(b) by 103 days.

(21) Appl. No.: 16/456,442

(22) Filed: Jun. 28, 2019

(65) Prior Publication Data

US 2020/0010243 A1 Jan. 9, 2020

Related U.S. Application Data

(63) Continuation-in-part of application No. 29/684,529, filed on Mar. 21, 2019, now Pat. No. Des. 890,459.

(60) Provisional application No. 62/693,698, filed on Jul. 3, 2018.

(51) Int. Cl.

| | |
|---|---|
| ***B65D 83/32*** | (2006.01) |
| ***B65D 25/02*** | (2006.01) |
| ***B44D 3/12*** | (2006.01) |

(52) U.S. Cl.

CPC ..... *B65D 25/02* (2013.01); *B44D 3/12* (2013.01)

(58) Field of Classification Search

CPC ..... B44D 3/123; B44D 3/128; B44D 3/12; B44D 3/126; B44D 3/127; B65D 2543/00092; B65D 25/02

USPC ..... 220/625, 571, 571.1, 636; 222/327, 328, 222/464.7, 377; 239/342

See application file for complete search history.

(56) References Cited

U.S. PATENT DOCUMENTS

| | | | | |
|---|---|---|---|---|
| 5,749,500 | A * | 5/1998 | Kraus | B65D 25/02 222/464.7 |
| 5,829,949 | A | 11/1998 | Brown | |
| 7,407,063 | B2 * | 8/2008 | Rockwell, III | B44D 3/12 220/608 |
| 2001/0004985 | A1 * | 6/2001 | Pertschi | B05B 9/03 220/570 |
| 2008/0110904 | A1 | 5/2008 | Smith | |
| 2012/0088714 | A1 | 4/2012 | Kumar et al. | |
| 2014/0117027 | A1 | 5/2014 | Ulstad | |

* cited by examiner

*Primary Examiner* — Don M Anderson
*Assistant Examiner* — Elizabeth J Volz
(74) *Attorney, Agent, or Firm* — Boudwin Intellectual Property; Daniel Boudwin

(57) ABSTRACT

A paint bucket insert. The paint bucket insert includes a base dimensioned to removably secure within a bucket, wherein an annular sidewall extends orthogonally away from the base along a perimeter thereof. The base is further concave defining an apex. A well is disposed within the base at the apex, wherein the well extends from a lower side of the base. The well can receive a paint sprayer hose or alternatively a paint roller therein.

6 Claims, 6 Drawing Sheets

PAINT BUCKET INSERT

CROSS REFERENCE TO RELATED APPLICATIONS

This application claims the benefit of U.S. Provisional Application No. 62/693,698 filed on Jul. 3, 2018 and U.S. Design Application No. 29/684,529 filed on Mar. 21, 2019. The above identified patent applications are herein incorporated by reference in their entirety to provide continuity of disclosure.

BACKGROUND OF THE INVENTION

The present invention relates to paint bucket inserts. More particularly, the present invention pertains to a paint bucket insert having a well disposed within a concave base at the apex of the concavity.

Many painters use airless spray pump painting systems designed to deliver paint to a sprayer at high pressure via a pump connected to a paint bucket or tank containing paint. Over time, the level of paint in the tank or bucket decreases, which typically leads to inconsistent flow through the spray system as air is pumped in with the remaining paint. Additionally, should the user draw paint directly from a traditional paint bucket, the flat base thereof causes uneven distribution of paint as the paint level drops, causing a similar problem.

Furthermore, painters frequently rely on paint rollers to apply paint in large swaths over a surface, however traditional paint buckets, as previously discussed present an uneven distribution of paint along the base thereof, leading to patchy or inconsistent paint distribution over the length of the paint roller. Therefore, a device that can be inserted into a typical paint bucket that provides a well to collect paint therein for even and efficient distribution of paint through paint spray systems and paint rollers is desired.

In light of the devices disclosed in the known art, it is submitted that the present invention substantially diverges in design elements from the known art and consequently it is clear that there is a need in the art for an improvement to existing paint bucket inserts. In this regard, the instant invention substantially fulfills these needs.

SUMMARY OF THE INVENTION

In view of the foregoing disadvantages inherent in the known types of paint bucket inserts now present in the known art, the present invention provides a paint bucket insert wherein the same can be utilized for providing convenience for the user when continuously accumulating paint within a well to be collected by a paint sprayer or paint roller.

The present system comprises a base dimensioned to removably secure within a bucket. An annular sidewall extends orthogonally away from a perimeter of the base. In some embodiments, the annular sidewall extends away from an upper side of the base, while in another embodiment, the annular sidewall extends away from a lower side of the base. The base is concave such that an apex is defined therein. A well is disposed within the base at the apex, wherein the well extends from the lower side of the base. In some embodiments, the well comprises a tubular member having an open upper end and a closed lower end. In another embodiment, the well is dimensioned to receive a hose of a paint spraying apparatus therein, such that a gap is defined between the well and the hose. In other embodiments, the apex is offset from a center of the base. In yet another embodiment, the well comprises an elongated cylindrical member extending along a diameter of the base. In some embodiments, a lip extends radially outwardly from a distal end of the annular sidewall, wherein the lip configured to rest flush on a rim of the bucket. In another embodiment, a distal end of the annular sidewall is coplanar with a lower end of the well.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
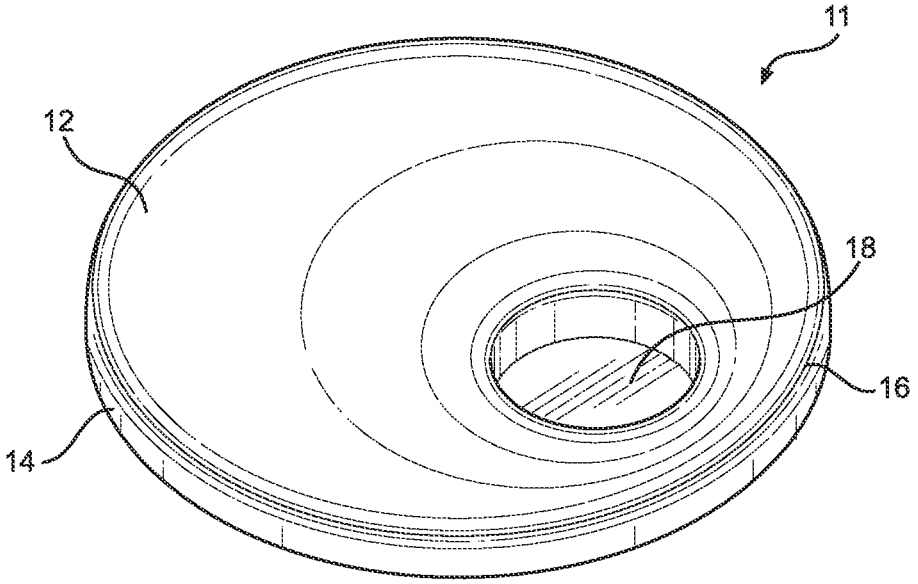
FIG. 1A shows a perspective view of an embodiment of the paint bucket insert.

Reference is made herein to the attached drawings. Like reference numerals are used throughout the drawings to depict like or similar elements of the paint bucket insert. The figures are intended for representative purposes only and should not be considered to be limiting in any respect.

Figure 1B:
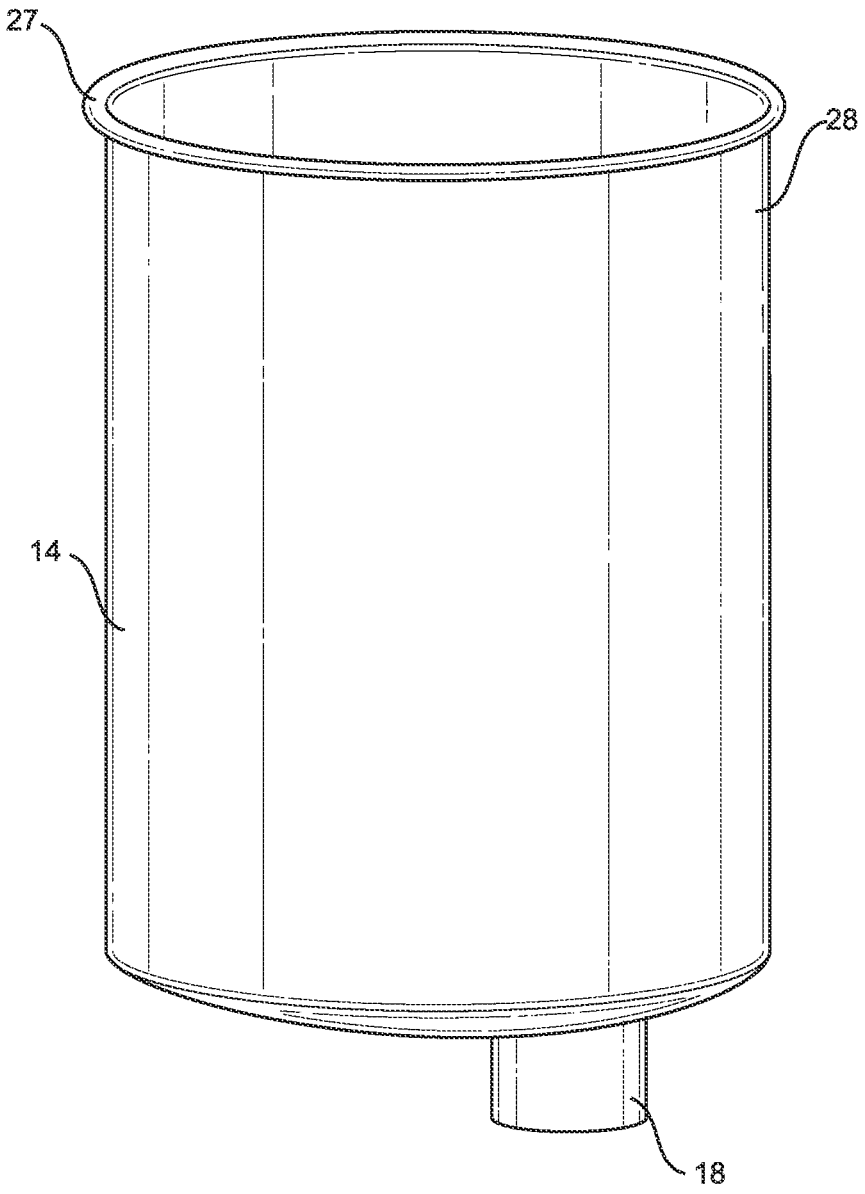
FIG. 1B shows a perspective view of an alternate embodiment of the paint bucket insert.
Figure 2A:
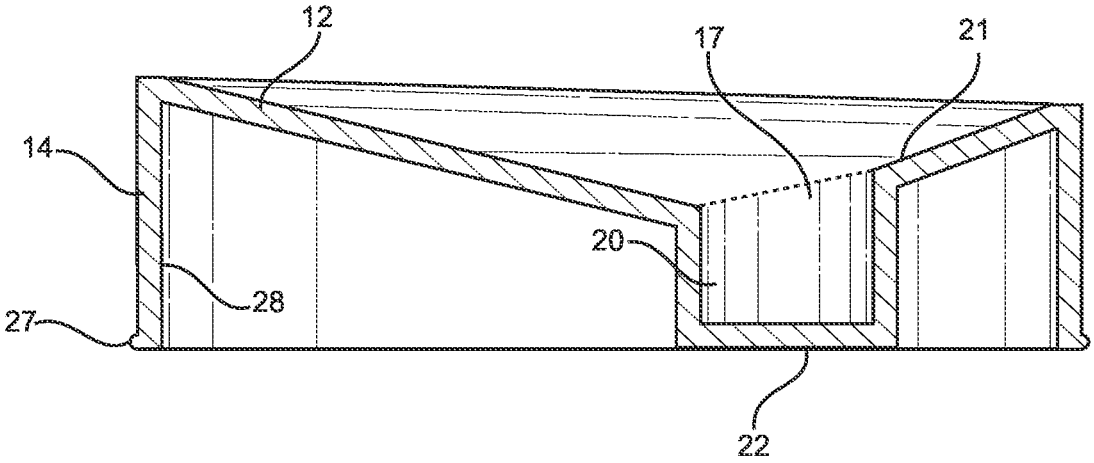
FIG. 2A shows a cross-sectional view of an embodiment of the paint bucket insert.
Figure 2B:
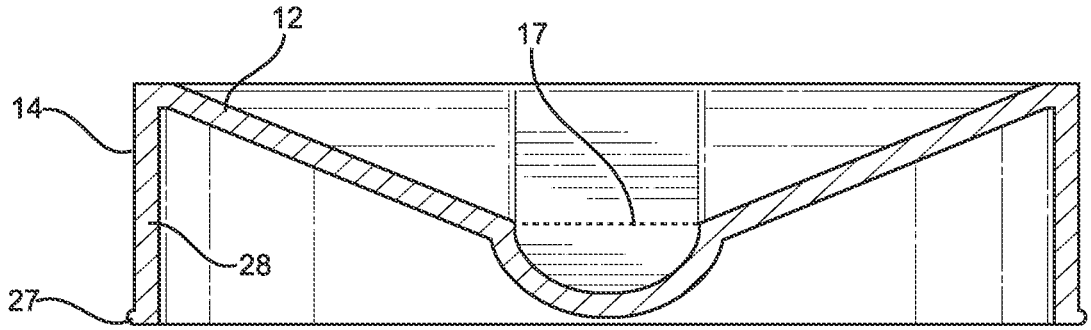
FIG. 2B shows a cross-sectional view of an alternate embodiment of the paint bucket insert.
Figure 3:
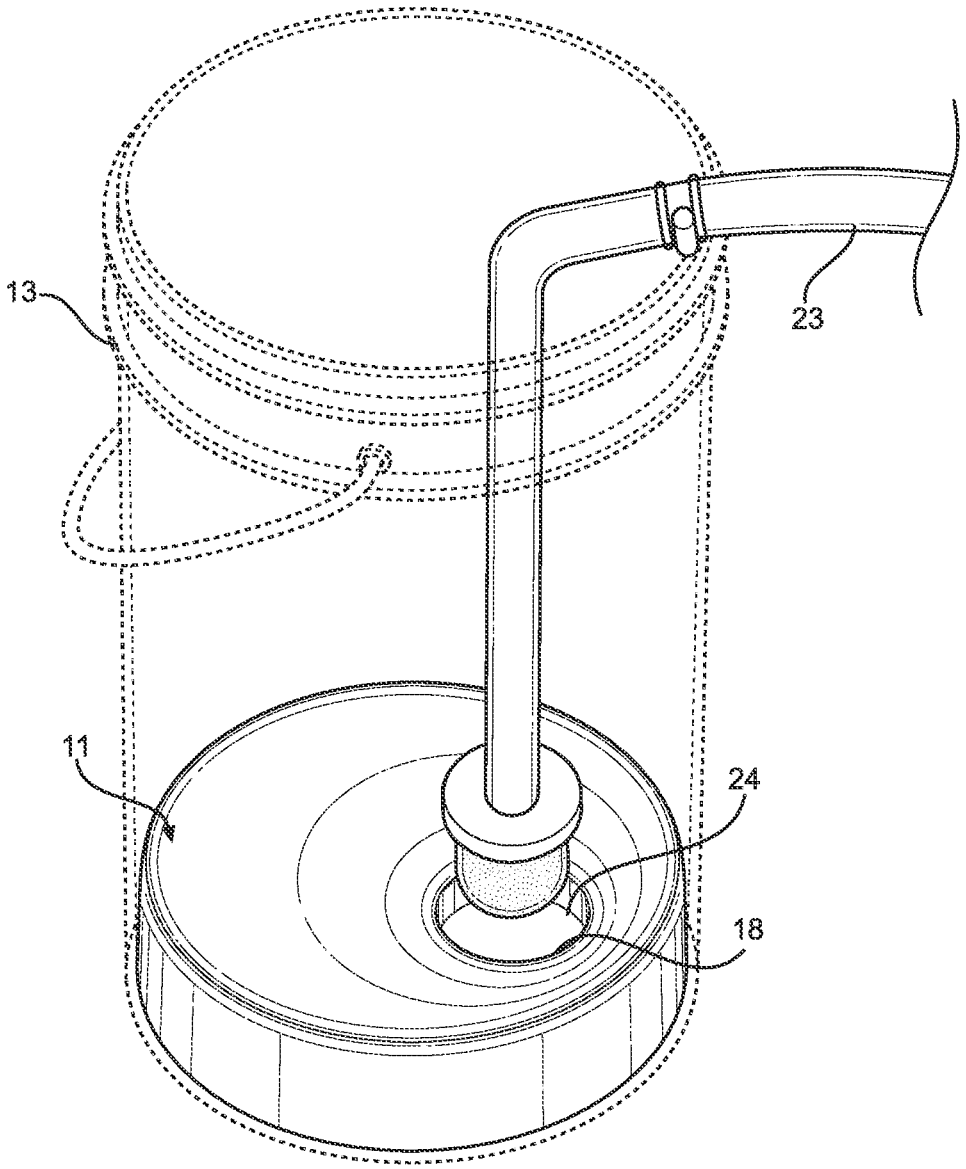
FIG. 3 shows a perspective view of an embodiment of the paint bucket insert in use.
Figure 4:
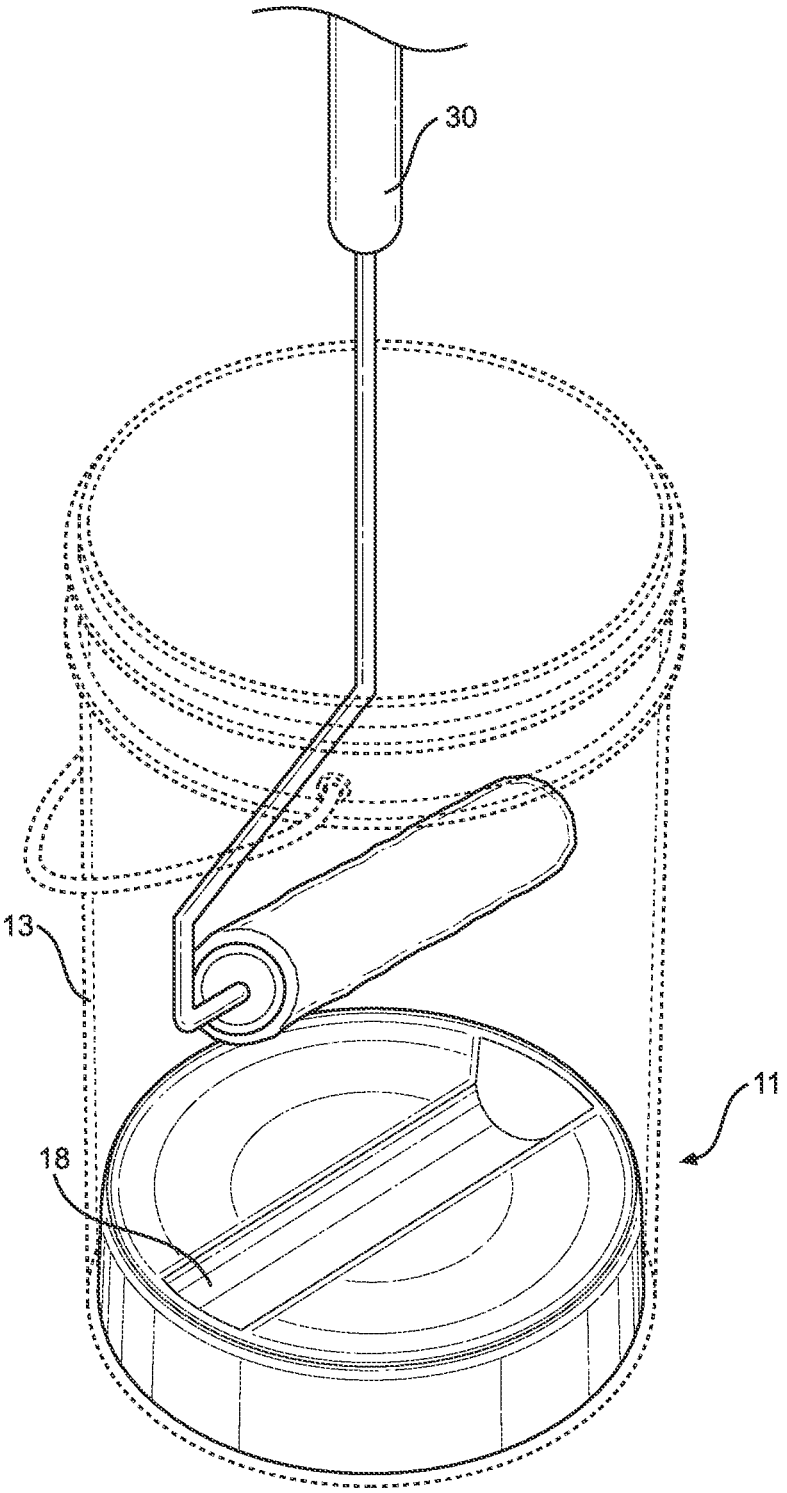
FIG. 4 shows a perspective view of an alternate embodiment of the paint bucket insert in use.

Referring now to FIGS. 1A and 1B, there is shown a perspective view of an embodiment of the paint bucket insert and a perspective view of an alternate embodiment of the paint bucket insert, respectively. The paint bucket insert 11 comprises a base 12 dimensioned to removably secure within an existing bucket (as shown in FIGS. 3 and 4, 13) via friction fit. A diameter of the base 12 can be various lengths, such that the paint bucket insert 11 can be used with various common sizes of paint buckets, such as 2 gallon and 5 gallon varieties. The base 12 is concave, allowing liquid, such as paint, placed thereon to collect at an apex (as shown in FIGS. 2A and 2B, 17) for efficient distribution onto a painting implement. An annular sidewall 14 extends orthogonally from a perimeter 16 of the base 12, wherein the annular sidewall 14 is configured to support the paint bucket insert 11 within the bucket. In the illustrated embodiment of FIG. 1A, the annular sidewall 14 extends from a lower side of the base 12 to support the base 12 against an interior sidewall of the bucket. In some embodiments, the annular sidewall 14 extends to rest flush against a bottom of the bucket to support the base 12 above the bottom of the bucket.

Figure 5:
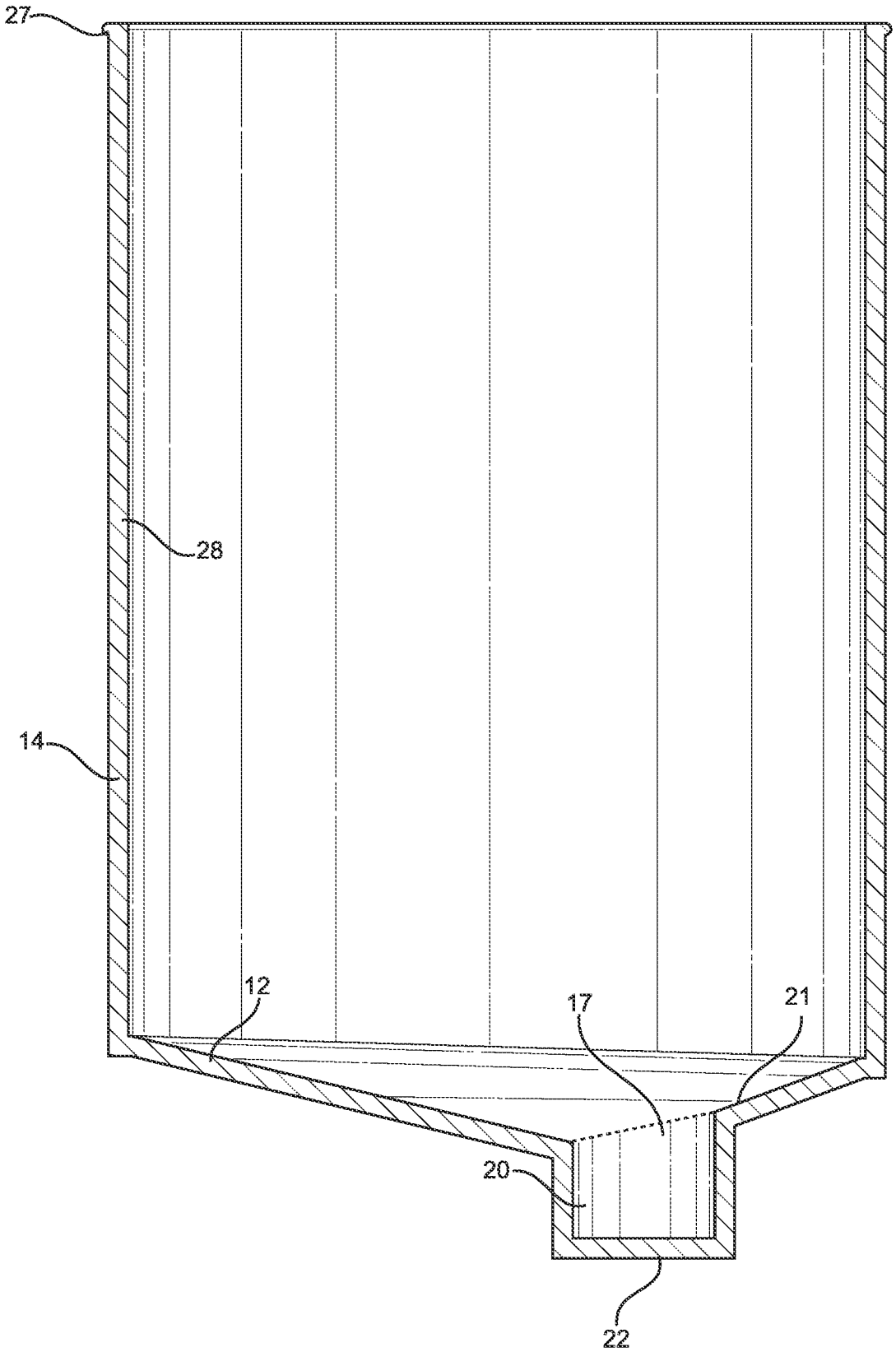
FIG. 5 shows a cross-sectional elevation view of the embodiment of the paint bucket insert shown in FIG. 1B.

In the illustrated embodiment of FIG. 1B and FIG. 5, the annular sidewall 14 extends orthogonally upwardly from an upper side of the base 12 about the perimeter 16 thereof. In this embodiment, the annular sidewall 14 serves to line the interior of the bucket, preventing paint from contacting the interior of the bucket entirely. Additionally, in the shown embodiment of FIG. 1B and FIG. 5, a lip 27 extends radially outward from a distal end 28 of the annular sidewall 14. The lip 27 is configured to rest flush against a rim of the bucket, thereby suspending the paint bucket insert 11 therein. The annular sidewall 14 can be various lengths to secure within buckets of various heights. In this way, the lip 27 further allows the base 12 to be suspended above the bottom of the bucket, allowing the paint bucket insert 11 to be used with a larger bucket than the height of the annular sidewall 14 would otherwise indicate.

A well 18 is disposed at the apex, the well 18 configured to collect a discrete volume of the liquid therein. The well 18 is dimensioned to receive a painting implement therein to allow for consistent distribution of paint thereto as paint is guided from the base 12 towards the well 18. In this way, paint is readily available to a user throughout the painting process, even as the volume of available paint decreases. The well 18 can be of various cross-sections to allow various painting implements to be received therein, such as, but not limited to, tubular to receive a paint sprayer inlet hose therein, an elongated cylinder to receive a paint roller, rectangular to receive a painting pad, and the like.

In some embodiments, the paint bucket insert 11 of FIG. 1A can be used in conjunction with the paint bucket insert 11 of FIG. 1B. In these embodiments, the paint bucket insert 11 of FIG. 1B can be a simple bucket liner composed of a material of insufficient strength to support the well 18 against the bottom of the bucket, and as such, the well 18 of the paint bucket insert 11 of FIG. 1B can be removably secured within the well 18 of the paint bucket insert 11 of FIG. 1A. In this way, the embodiment of FIG. 1A provides support to the embodiment of FIG. 1B, allowing a user to readily use a disposable paint bucket liner with a bucket using the paint bucket insert 11 of FIG. 1A, thereby reducing expense and effort required to clean the bucket between uses.

Referring now to FIGS. 2A and 2B, there is shown a cross-sectional view of an embodiment of the paint bucket insert and a cross-sectional view of an alternate embodiment of the paint bucket insert, respectively. In the illustrated embodiment of FIG. 2A, the well 18 comprises a tubular member 20 having an open upper end 21 and a closed lower end 22. The tubular member 20 is dimensioned to receive a hose from a paint spraying apparatus therein, such that a gap is formed between the hose and the tubular member 20 allowing paint to continue to accumulate therein during use. The tubular member 20 extends from the lower side of the base 12 at the apex 17 of the concavity thereof, such that any liquid placed on the base 12 is guided towards the tubular member 20. In some embodiments, the closed lower end 22 is coplanar with the distal end 28 of the annular sidewall 14, allowing the entirety of the lower portion of the paint bucket insert to rest flush on the bottom of the bucket. In this way, the maximum volume of the bucket may be used in conjunction with the paint bucket insert. However, in some embodiments, the annular sidewall 14 has a length less than a depth of the concavity, providing a lighter, more compact, and less expensive construction as less material is necessary for manufacture. Additionally, the minimized length of the annular sidewall 14 reduces the volume of paint potentially lost between the interior of the bucket and the annular sidewall 14 in embodiments using the lip 27. Further, in the illustrated embodiment of FIG. 2A, the apex 17 is offset from a center of the base 12, such that a paint sprayer inlet hose can be placed within the tubular member 20 nearer to a side of the bucket. In this way, the risk of tipping the bucket due to movement of the paint sprayer or the weight of the paint sprayer hose resting against the bucket is minimized.

In the illustrated embodiment of FIG. 2B, the well 18 comprises an elongated cylinder extending across a diameter of the base 12, wherein the elongated cylinder is dimensioned to receive a paint roller therein. In this embodiment, the well 18 is disposed at the apex 17 along a center of the base 12, allowing the well 18 to receive various sizes of paint roller therein. In this way, the maximum length of paint roller accepted by the well 18 is defined by the diameter of the bucket within which the paint bucket insert is placed. Similar to the embodiment shown in FIG. 2A, the lower end of the well 18 is, in some embodiments, coplanar with the distal end 28 of the annular sidewall 14, allowing the lower portion of the paint bucket insert to rest flush on the bottom of the bucket to maximize available volume therein. However, as described above, in some embodiments, the annular sidewall 14 has a length less than a depth of the concavity, providing a lighter, more compact, and less expensive construction as less material is necessary for manufacture.

In the illustrated embodiments of FIGS. 2A and 2B, the lip 27 extends radially from the distal end 28 of the annular sidewall 14. In these embodiments, wherein the annular sidewall 14 extends orthogonally from the lower side of the base 12, the lip 27 is configured to removably secure the base 12 within the bucket via friction fit. The lip 27 can be of various lengths to allow the paint bucket insert to be used with buckets of various diameter while maintaining a consistent base 12 size, however, in a preferred embodiment, the length of the lip 27 is minimized to reduce the annular volume between the bucket and the base 12 within which paint can accumulate. Additionally, in some embodiments, the lip 27 is configured to form a liquid impermeable seal with the interior wall of the bucket, preventing paint from collecting and being lost in the void space beneath the base 12.

Referring now to FIGS. 3 and 4, there is shown a perspective view of an embodiment of the paint bucket insert in use and a perspective view of an alternate embodiment of the paint bucket insert in use, respectively. In the illustrated embodiments, the paint bucket insert 11 is placed within the bucket 13 such that the paint bucket insert 11 is removably secured therein. In embodiments having upwardly extending annular sidewalls, the lip is placed on the rim of the bucket 13 to support the base therein. The bucket 13 can then be filled with a desired paint. In embodiments akin to FIG. 3, the hose 23 can be inserted into the well 18 before adding the paint, allowing the user to more readily visualize the location of the well 18. The painting implement can then be used to collect paint from the well 18, whether via the inlet hose 23 of a paint spraying apparatus as shown in FIG. 3, or a paint roller 30 as shown in FIG. 4. As paint is used from the bucket, the concave nature of the base allows further paint to pool within the well 18. In the illustrated embodiment of FIG. 3, the gap 24 formed between the well 18 and the hose 23 allows paint to continue to collect within the well 18 while the hose 23 is secured therein. In this way, the paint bucket insert 11 provides convenience and efficiency in providing a consistent pool of paint to be collected by the user for use with a painting implement.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint bucket insert, comprising:

a base dimensioned to removably secure within a bucket;

an annular sidewall extending orthogonally upward from an upper side of the base along a perimeter thereof;

wherein an interior volume is defined between the annular sidewall and the upper side of the base;

wherein the base is concave defining an apex;

a well disposed within the base at the apex;

wherein the well extends from a lower side of the base, the well being continuous with the annular sidewall and in fluid communication with the interior volume;

wherein a lip extends radially outward from a distal end of the annular sidewall, the lip configured to rest flush on a rim of the bucket.

2. The paint bucket insert of claim 1, wherein the well comprises a tubular member having an open upper end and a closed lower end.

3. The paint bucket insert of claim 2, wherein the well is dimensioned to receive a hose of a paint spraying apparatus therein, such that a gap is defined between the well and the hose.

4. The paint bucket insert of claim 1, wherein the apex is offset from a center of the base.

5. The paint bucket insert of claim 1, wherein the well comprises an elongated cylindrical depression having a longitudinal axis extending along a diameter of the base.

6. A paint bucket insert, consisting of:

a base dimensioned to removably secure within a bucket;

an annular sidewall extending orthogonally upward from an upper side of the base along a perimeter thereof;

wherein an interior volume is defined between the annular sidewall and the upper side of the base;

wherein the base is concave defining an apex;

a well disposed within the base at the apex;

wherein the well extends from a lower side of the base, the well being continuous with the annular sidewall and in fluid communication with the interior volume;

a lip extending radially outward from a distal end of the annular sidewall, the lip configured to rest flush on a rim disposed about an upper opening of the bucket.

* * * * *